United States Patent [19]

Maio

[11] Patent Number: 4,767,117

[45] Date of Patent: Aug. 30, 1988

[54] AMUSEMENT RIDE AND GAME

[76] Inventor: Anthony M. Maio, 2053 Redfern Dr., Indianapolis, Ind. 46227

[21] Appl. No.: 897,868

[22] Filed: Aug. 19, 1986

Related U.S. Application Data

[63] Continuation-in-part of Ser. No. 669,826, Nov. 9, 1984.

[51] Int. Cl.[4] ..... A63G 1/00

[52] U.S. Cl. ..... 272/28 R; 273/352; 272/1 R

[58] Field of Search ..... 272/31 A, 37, 28 R, 272/1 B, 40, 41; 273/352, 118 A, 1 G, 316; 104/53

[56] References Cited

U.S. PATENT DOCUMENTS

| | | | |
|---|---|---|---|
| 326,474 | 9/1885 | Bungarz | 272/48 |
| 1,221,803 | 3/1917 | Johnston | 273/352 |
| 1,327,464 | 1/1920 | Dewick et al. | 272/31 A |
| 1,524,598 | 1/1925 | Tate | 272/31 R |
| 2,216,278 | 10/1940 | New | 272/31 A |
| 2,364,699 | 12/1944 | Eastman | 272/41 |
| 2,873,972 | 2/1953 | Bartlett | 273/316 |
| 3,112,929 | 12/1963 | Gisser | 272/31 R |
| 3,406,969 | 10/1968 | Tisdell et al. | 273/1 G |
| 3,562,950 | 2/1971 | Genin | 104/53 |
| 3,730,524 | 5/1973 | Green | 272/52.5 |

FOREIGN PATENT DOCUMENTS

| | | | |
|---|---|---|---|
| 119277 | 10/1930 | Austria | 272/41 |

*Primary Examiner*—Robert A. Hafer
*Assistant Examiner*—Samuel Rimell
*Attorney, Agent, or Firm*—Woodard, Emhardt, Naughton, Moriarty & McNett

[57] ABSTRACT

There is illustrated a combination amusement ride and game including a rotating carousel for carrying a plurality of players. Adjacent to the carousel is a ramp having a tee at its lower end and a target at its elevated end. Balls are introduced to the tee in synchrony with the approach of each player toward the ramp. Each player is provided with a mallet for striking the teed ball to direct the ball up the ramp toward the target. Scoring apparatus synchronized with the carousel are provided for crediting each score to the proper player.

3 Claims, 3 Drawing Sheets

AMUSEMENT RIDE AND GAME

REFERENCE TO RELATED APPLICATIONS

This application is a continuation-in-part of U.S. patent application Ser. No. 669,826, filed on Nov. 9, 1984 by the same inventive entity, and entitled AMUSEMENT RIDE AND GAME.

BACKGROUND OF THE INVENTION

1. Field of the Invention

The present invention relates generally to amusement park type rides and games of skill, and in particular to a combination of a ride with a game of skill involving projectiles and a target.

2. Background of the Prior Art

There are two general classes of activities which may be found in almost every amusement park. The first is a mechanical ride which depends for its entertainment value upon mechanically directed forces applied to one's body to induce varying acceleration of the person in directions not normally experienced in everyday life. Examples are Ferris wheels, roller coasters, variously configured merry-go-rounds, or carousels, etc. The second class of activities are those games of skill (and chance) which involve launching a projectile at a target, with various points to be earned in accordance with the accuracy of the trajectory. Examples are pin ball, darts, skeetball, knocking over milk bottles, etc. The present invention offers a combination of these two classes of activities within a single amusement device.

SUMMARY OF THE INVENTION

An amusement ride and game includes a ramp having a lower end and an elevated end, a plurality of balls adapted to be rolled on the ramp, and a target associated with and located at the elevated end of the ramp. Tee means are located proximate the lower end of the ramp for holding a ball in a teed condition. Vehicle means are provided for transporting a plurality of human players such that each player is periodically brought into proximity with the tee means. Further included are ball synchronizing means for introducing a ball to the tee means in synchrony with the approach of each player to the tee means. Each player is provided with a mallet, each mallet having a head configured for striking a teed ball and directing the ball up the ramp toward the target and having a handle configured to be grasped by a player and of sufficient length to permit a player to strike a teed ball when the player is in proximity to the tee means. Also included are scoring means synchronized with the vehicle means for registering a score whenever a ball is received through an aperture of the target and for crediting the score to a particular player and score display means for displaying the score of each player.

It is an object of the present invention to provide an amusement activity combining a mechanical ride with a game of skill and chance.

It is a further object of the present invention to provide a game of skill having an elevated level of difficulty.

Further objects and advantages of the present invention will become apparent from the following description.

DESCRIPTION OF THE PREFERRED EMBODIMENT

Figure 1:
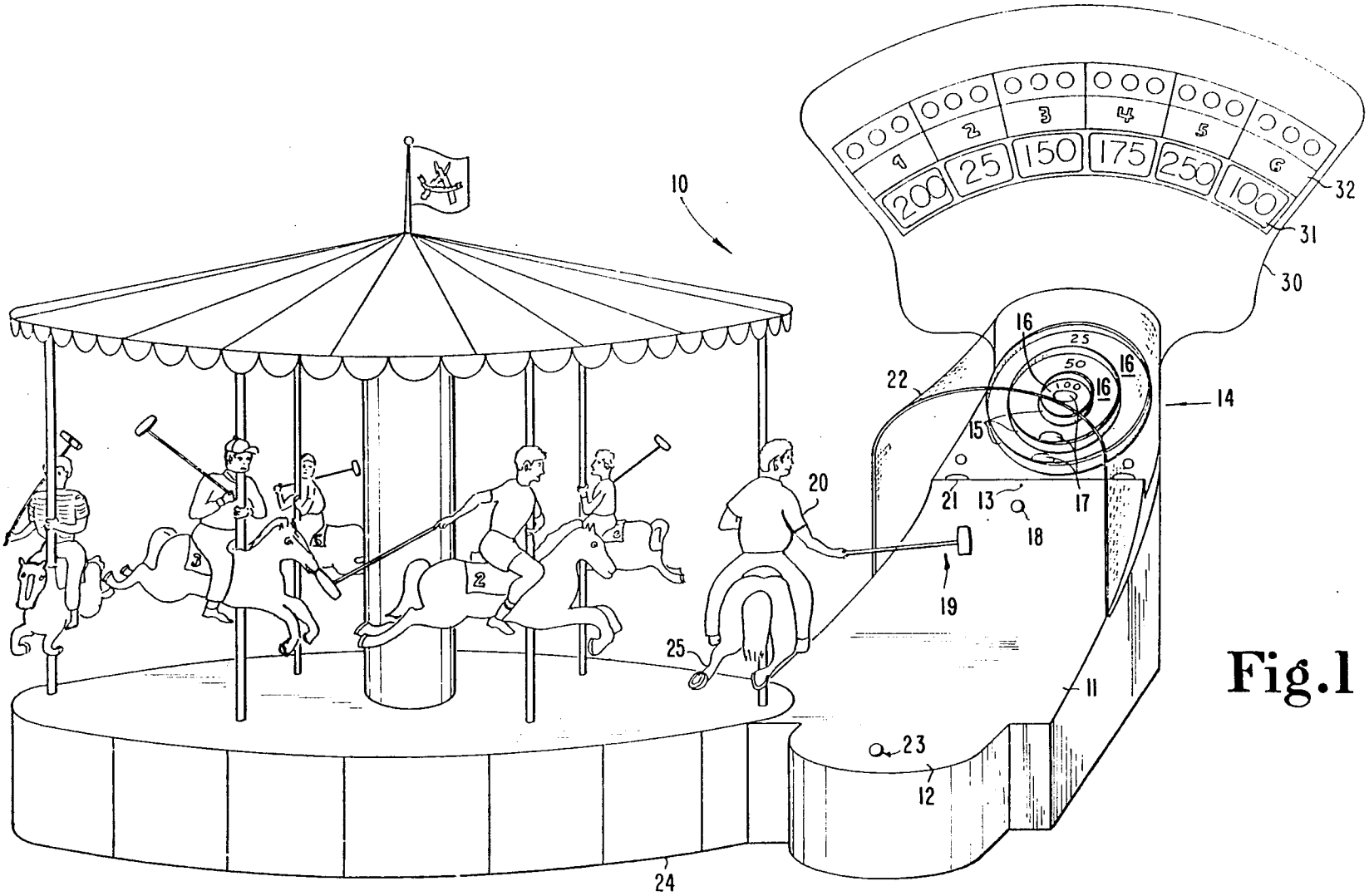
FIG. 1 is a perspective view of an amusement ride and game, in accordance with the present invention.
Figure 2:
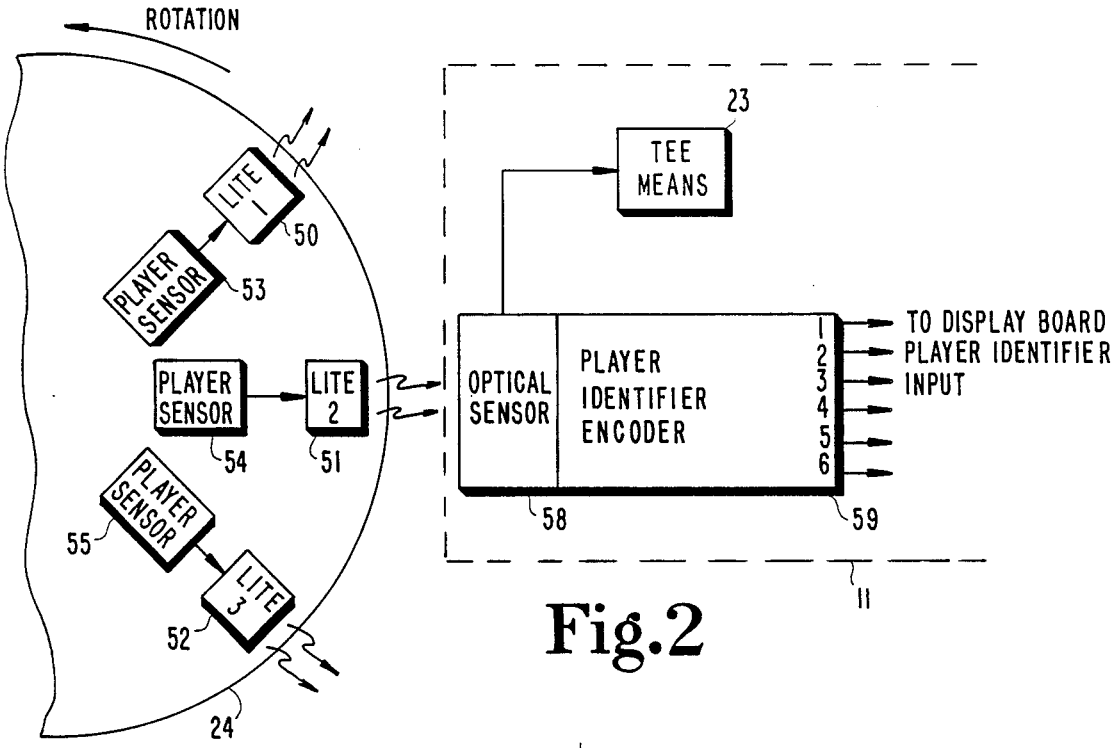
FIG. 2 is a schematic representation in plan view of the carousel and ramp of the amusement ride and game of FIG. 1, showing in particular a portion of the means for synchronizing the rotation of the carousel with the tee means and scoring means of the present invention.
Figure 3:
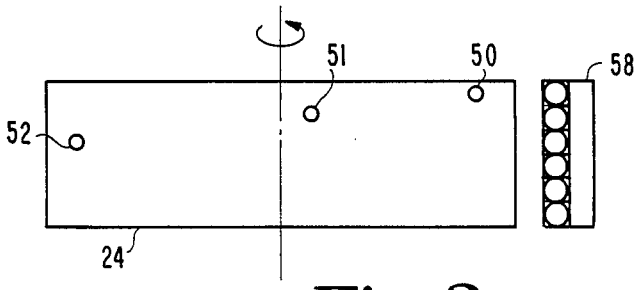
FIG. 3 is a schematic representation in elevational view of the carousel and optical sensor of FIG. 2, showing in particular the spatial relationship therebetween.

Referring in particular to FIG. 1, there is illustrated a combination amusement ride and game 10, which in its preferred embodiment is a combination of the games of polo and "skeetball" with a carousel ride. Included is a ramp 11 having a lower end 12 and an elevated end 13. At the elevated end 13 of ramp 11 is located a target 14 including a series of concentric rings 15 forming annular channels 16 therebetween. Within each annular channel 16 is an aperture 17 sized for receiving a ball 18 therethrough. As the game is intended to be played, a ball is struck by a mallet 19 held by a player 20 and thereby directed up ramp 13 toward target 14 with the object being to cause the ball to land within the centermost ring of rings 15 and pass through the aperture therein for maximum score. Lesser scores are obtained when the ball falls within the outermost rings. Should the ball fall outside the target, it will tend to roll toward default apertures 21 with no score accruing. A shield 22 is provided to retain misdirected shots.

A tee means (indicated generally at point 23) is associated with ramp 11 and located at the lower end 12 thereof. The tee means can be any structure adapted to hold a ball in a teed condition where it would be subject to be struck by a mallet 19.

Further included is a vehicle means associated with ramp 11 for transporting a plurality of human players 20 such that each player is periodically brought into proximity with tee 23. In the preferred embodiment, such a vehicle is a carousel 24. Carousel 24 is adapted in conventional fashion to rotate in a counterclockwise direction (as seen from above) and is provided with a plurality of seating locations for carrying the players. Preferably, the seating locations are configured as horses 25. Horses 25 can be adapted to move up and down or remain vertically stationary.

Carousel 24 is located relative to ramp 11 such that the longitudinal centerline of ramp 11 is perpendicular to a radius of carousel 24 passing through a player 20 who is located in proximity with tee 23.

Ball synchronizing means in the form of an optical sensor, linkage and supply of balls, are provided in association with ramp 11 for introducing a ball at tee 23 in synchrony with the approach of a player 20 toward tee 23. A variety of sequential indexing structures are available for this function and the sensor provides the triggering means to activate the structure. Thus there will always be a ball teed up and ready to be struck as each player comes into scoring position.

Each player is provided with a mallet 19 having a head configured for striking a teed ball located at tee 23 and directing the ball up ramp 11 toward target 14. Each mallet has a handle of sufficient length to permit the player to reach and strike the teed ball when he is in proximity to tee 23.

Further associated with ramp 11 is a scoring means including a score count encoder and a plurality of counters for registering a score whenever a ball is received through an aperture 17, with the value of the score depending upon which aperture the ball goes through. The scoring means is synchronized with the carousel so that each registered score is credited to a particular player. A display board 30 is associated with ramp 11 for displaying the score (as indicated at point 31) of each player in accordance with the player's number (as indicted at point 32).

Referring to FIGS. 2–5, there is illustrated in schematic fashion the ball synchronizing means and scoring means referred to above. As shown particularly in FIGS. 2 and 3, carousel 24 is equipped with perimetrically spaced lamps, such as 50, 51 and 52, each corresponding to a particular player, there being as many lamps as there are player seating positions. Each lamp is activated by a player sensor, such as 53, 54, and 55, which senses the presence of a player at the seating position. The player sensor can be any suitable device for reliably detecting the presence of a player, such as a weight sensor or a photoelectric cell. As will become apparent from the description of the ball synchronizing means and scoring means below, the absence of a player from a particular seating location is automatically accounted for because the lamp corresponding to that location will remain unlit.

Associated with ramp 11 is an optical sensor 58 having as many vertically spaced sensor channels as there are carousel lamps. The carousel lamps are vertically spaced and aligned with optical sensor 58, such that each lamp activates one and only one channel of optical sensor 58 as the lamp passes by optical sensor 58 upon rotation of carousel 24. Upon activation of any channel of optical sensor 58, a signal is sent to tee means 23 to indicate the approach of a player to the tee, and causing tee means 23 to tee up a ball. Player identifier encoder 59 is in communication with optical sensor 58, and sends an enabling signal to display board 30 (FIG. 5) to enable the score adder which corresponds to the player seating location sensed by optical sensor 58.

Figure 4:
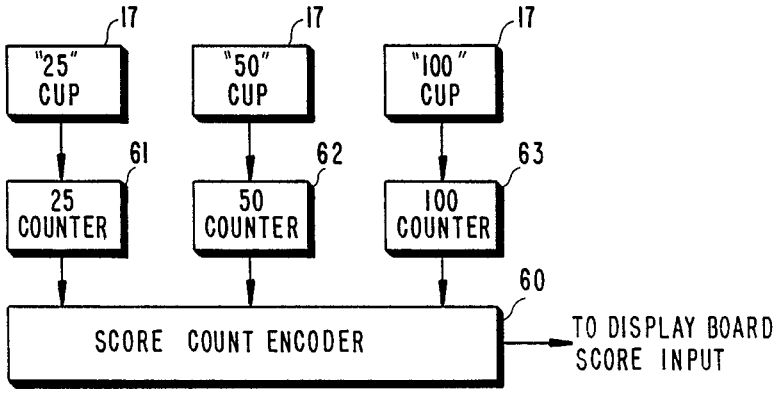
FIG. 4 is a schematic drawing of a further portion of the means for synchronizing the rotation of the carousel with the tee means and scoring means of the present invention.
Figure 5:
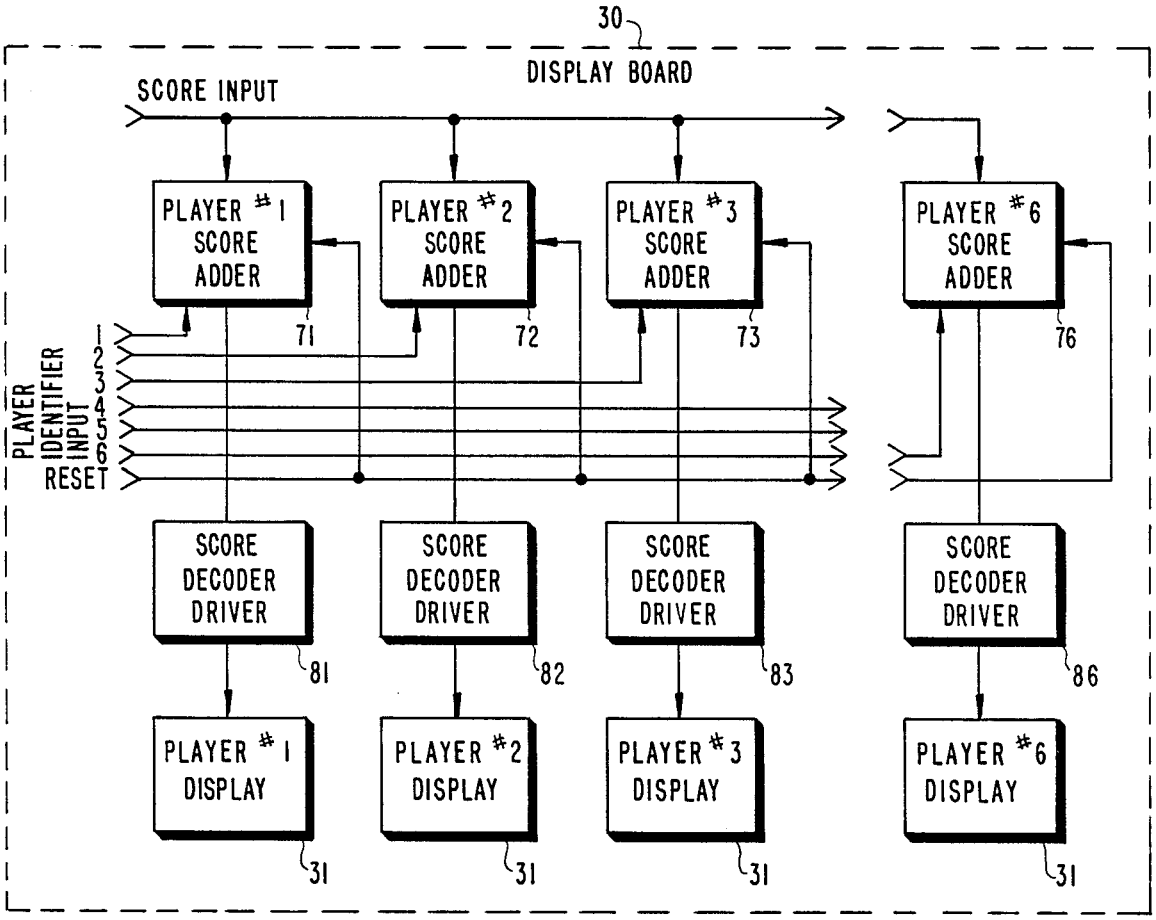
FIG. 5 is a schematic drawing of a further portion of the means for synchronizing the rotation of the carousel with the tee means and scoring means of the present invention.

Referring now to FIG. 4, there is illustrated the score count encoder 60 which receives the score count from counters 61, 62 or 63, each of which is activated by a ball passing through the appropriate aperture 17. The output of the score count encoder 60 is sent to display board 30, where the score count is added in whichever player score adder (71, 72, 73 or 76) has been enabled by player identifier encoder 59. The output of each player score adder is displayed on the appropriate player display 31, driven by a score decoder driver (81, 82, 83 or 86).

While a particular embodiment of the invention has been illustrated and described in detail in the drawings and foregoing description, it is to be understood that this description is made only by way of example and not as a limitation to the scope of the invention which is claimed below.

What I claim is:

1. An amusement ride and game, comprising:

a ramp having a lower end and an elevated end;

a plurality of balls adapted to be rolled on said ramp;

a target associated with and located at the elevated end of said ramp, said target defining a plurality of apertures, each aperture being sized and adapted for receiving therethrough said plurality of balls;

tee means associated with said ramp for providing a ball of said plurality of balls in a teed condition proximate the lower end of said ramp;

a carousel associated with said ramp and having a plurality of player-carrying locations thereon, said carousel being adapted to rotate about a substantially vertical axis such that each player-carrying location is intermittently rotated into proximity with said tee means; and a plurality of mallets, one for each player, each mallet being configured to permit a player to strike a teed ball and direct said ball up said ramp toward said target when the player is in proximity to said tee means.

2. The amusement ride and game of claim 1 and further including:

scoring means synchronized with said carousel for registering a score whenever a ball is received through an aperture of said target and for crediting said score to a particular player; and score display means for displaying the score of each player.

3. The amusement ride and game of claim 2 and further including ball synchronizing means for introducing a ball of said plurality of balls to said tee means in synchrony with the approach of a player to said tee means.

* * * * *